US010674571B2

(12) United States Patent
Hunter, Jr.

(10) Patent No.: US 10,674,571 B2
(45) Date of Patent: Jun. 2, 2020

(54) APPARATUS FOR PROVIDING RF STIRRING WITH SOLID STATE COMPONENTS

(71) Applicant: Illinois Tool Works Inc., Glenview, IL (US)

(72) Inventor: Richard E. Hunter, Jr., Liberty Township, OH (US)

(73) Assignee: ILLINOIS TOOL WORKS, INC., Glenview, IL (US)

( * ) Notice: Subject to any disclaimer, the term of this patent is extended or adjusted under 35 U.S.C. 154(b) by 1144 days.

(21) Appl. No.: 14/848,640

(22) Filed: Sep. 9, 2015

(65) Prior Publication Data

US 2017/0071036 A1 Mar. 9, 2017

(51) Int. Cl.

| | |
|---|---|
| ***H05B 6/72*** | (2006.01) |
| ***H05B 6/70*** | (2006.01) |
| ***H05B 6/68*** | (2006.01) |

(52) U.S. Cl.

CPC ..... *H05B 6/72* (2013.01); *H05B 6/686* (2013.01); *H05B 6/70* (2013.01)

(58) Field of Classification Search

CPC ... H05B 6/72; H05B 6/64; H05B 6/66; H05B 6/68

USPC ..... 219/702, 704, 710, 712, 715

See application file for complete search history.

(56) References Cited

U.S. PATENT DOCUMENTS

| | | | | |
|---|---|---|---|---|
| 4,223,310 | A | 9/1980 | Davidson et al. | |
| 5,558,800 | A * | 9/1996 | Page | H05B 6/72 219/695 |
| 8,222,580 | B2 * | 7/2012 | Lee | H05B 6/74 219/685 |
| 8,658,953 | B2 * | 2/2014 | McFadden | A21B 1/245 219/691 |
| 8,680,446 | B2 * | 3/2014 | Nobue | H05B 6/6402 219/702 |
| 9,648,670 | B2 * | 5/2017 | Nobue | H05B 6/686 |
| 2004/0206755 | A1 * | 10/2004 | Hadinger | H05B 6/80 219/761 |
| 2007/0194011 | A1 * | 8/2007 | McFadden | A21B 1/245 219/681 |
| 2010/0176121 | A1 * | 7/2010 | Nobue | H05B 6/686 219/716 |
| 2010/0176123 | A1 * | 7/2010 | Mihara | H05B 6/686 219/746 |
| 2011/0168699 | A1 * | 7/2011 | Oomori | H01L 21/67115 219/748 |
| 2012/0067872 | A1 * | 3/2012 | Libman | H05B 6/647 219/702 |
| 2012/0103975 | A1 * | 5/2012 | Okajima | H05B 6/6447 219/660 |

(Continued)

*Primary Examiner* — Dana Ross
*Assistant Examiner* — Ayub A Maye
(74) *Attorney, Agent, or Firm* — Burr & Forman, LLP

(57) ABSTRACT

An oven may include a cooking chamber configured to receive a food product, an antenna assembly and a cooking controller. The antenna assembly may include a plurality of antennas provided in increments corresponding to respective zones of the cooking chamber. The cooking controller may be operably coupled to the antenna assembly to selectively distribute power to respective ones of the antennas of the antenna assembly to provide radio frequency energy into the respective zones in a selected pattern.

20 Claims, 6 Drawing Sheets

(56) References Cited

U.S. PATENT DOCUMENTS

| | | | | |
|---|---|---|---|---|
| 2012/0312801 | A1* | 12/2012 | Bilchinsky | H05B 6/705<br>219/438 |
| 2013/0175262 | A1* | 7/2013 | Gharpurey | H05B 6/72<br>219/745 |
| 2013/0334214 | A1* | 12/2013 | Yogev | H05B 6/6441<br>219/702 |
| 2014/0231418 | A1* | 8/2014 | Ikeda | H05B 6/70<br>219/705 |
| 2015/0034632 | A1* | 2/2015 | Brill | H05B 6/70<br>219/697 |

* cited by examiner

200

| All Source Voltages = 1V (peak) | | | | | | | | Total Power | | 0.04 | | Total Output Power |
|---|---|---|---|---|---|---|---|---|---|---|---|---|
| Source 1 Phase | Source 2 Phase | Source 3 Phase | Source 4 Phase | Probe 1 (R1) Voltage | Probe 2 (R2) Voltage | Probe 3 (R3) Voltage | Probe 4 (R4) Voltage | Probe 1 (R1) Power | Probe 2 (R2) Power | Probe 3 (R3) Power | Probe 4 (R4) Power | |
| 0 | 0 | 0 | 0 | 1.00 | 1.00 | 1.00 | 1.00 | 0.010 | 0.010 | 0.010 | 0.010 | 0.040 |
| 90 | 0 | 90 | 0 | 0.00 | 0.00 | 1.41 | 1.41 | 0.000 | 0.000 | 0.020 | 0.020 | 0.040 |
| 0 | 90 | 0 | 90 | 1.41 | 1.41 | 0.00 | 0.00 | 0.020 | 0.020 | 0.000 | 0.000 | 0.040 |
| -90 | 0 | 0 | 90 | 2.00 | 0.00 | 0.00 | 0.00 | 0.040 | 0.000 | 0.000 | 0.000 | 0.040 |
| 90 | 0 | 0 | -90 | 0.00 | 0.00 | 0.00 | 2.00 | 0.000 | 0.000 | 0.000 | 0.040 | 0.040 |
| 0 | 90 | -90 | 0 | 0.00 | 2.00 | 0.00 | 0.00 | 0.000 | 0.040 | 0.000 | 0.000 | 0.040 |
| 0 | -90 | 90 | 0 | 0.00 | 0.00 | 2.00 | 0.00 | 0.000 | 0.000 | 0.040 | 0.000 | 0.040 |

FIG. 5

APPARATUS FOR PROVIDING RF STIRRING WITH SOLID STATE COMPONENTS

TECHNICAL FIELD

Example embodiments generally relate to cooking technology and, more particularly, relate to an apparatus that enables the provision of a RF or microwave oven that can provide stirring without a mechanical stirrer or magnetron.

BACKGROUND

In some cases, microwave cooking may be faster than convection or other types of cooking Thus, microwave cooking may be employed to speed up the cooking process. Moreover, microwave ovens tend to be fairly compact and popular household appliances. Although microwave ovens have remained popular for many years, they are known to have certain limitations when it comes to cooking In this regard, a microwave oven may not be ideal for cooking of certain types of foods (depending on geometry and density). In particular, microwave ovens may not be able to effectively brown foods and may have uneven cooking in various locations therein.

Given that browning may add certain desirable characteristics in relation to taste and appearance, it may be necessary to employ another cooking method in addition to microwave cooking in order to achieve browning. Other accessories can sometimes be provided to enhance the browning capabilities of microwave ovens. Meanwhile, the other limitation of microwave ovens, regarding the uneven cooking experienced therein, generally relates to the fact that different rates of energy absorption may be experienced in different parts of the food being cooked. Typical methods for curing this deficiency include the provision of a stirrer or a turntable.

A stirrer may be a type of fan, or other device, that can reflect microwave energy while the stirrer turns. The reflection, coupled with the turning of the stirrer, is aimed at providing a more even power distribution in the oven cavity. However, the use of mechanical stirring and magnetrons in conventional microwave ovens generally means lower life times than could be provided with other components.

BRIEF SUMMARY OF SOME EXAMPLES

Some example embodiments may a power distribution system that employs multiple a solid state, high power sources that can provide stirring (or more even energy absorption characteristics) without a magnetron and without any mechanical stirring mechanism. Simply eliminating the magnetron and mechanical stirrer alone can immediately extend the useful life of an oven that employs example embodiments. However, in some cases, cost may be reduced and performance may also be increased by employing example embodiments.

In an example embodiment, an oven is provided. The oven may include a cooking chamber configured to receive a food product, an antenna assembly and a cooking controller. The antenna assembly may include a plurality of antennas provided in increments corresponding to respective zones of the cooking chamber. The cooking controller may be operably coupled to the antenna assembly to selectively distribute power to respective ones of the antennas of the antenna assembly to provide radio frequency energy into the respective zones in a selected pattern.

In another example embodiment, a power distribution system for an oven is provided. The power distribution system may include an antenna assembly and a cooking controller. The antenna assembly may include a plurality of antennas provided in increments corresponding to respective zones of a cooking chamber of the oven. The cooking controller may be operably coupled to the antenna assembly to selectively distribute power to respective ones of the antennas of the antenna assembly to provide radio frequency energy into the respective zones in a selected pattern.

Some example embodiments may improve the cooking performance and/or improve the operator experience when cooking with an oven employing an example embodiment.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 5 illustrates a table showing phase combinations to excite the antenna combinations that may be desired according to an example embodiment; and FIG. 6, which includes

DETAILED DESCRIPTION

Figure 1:
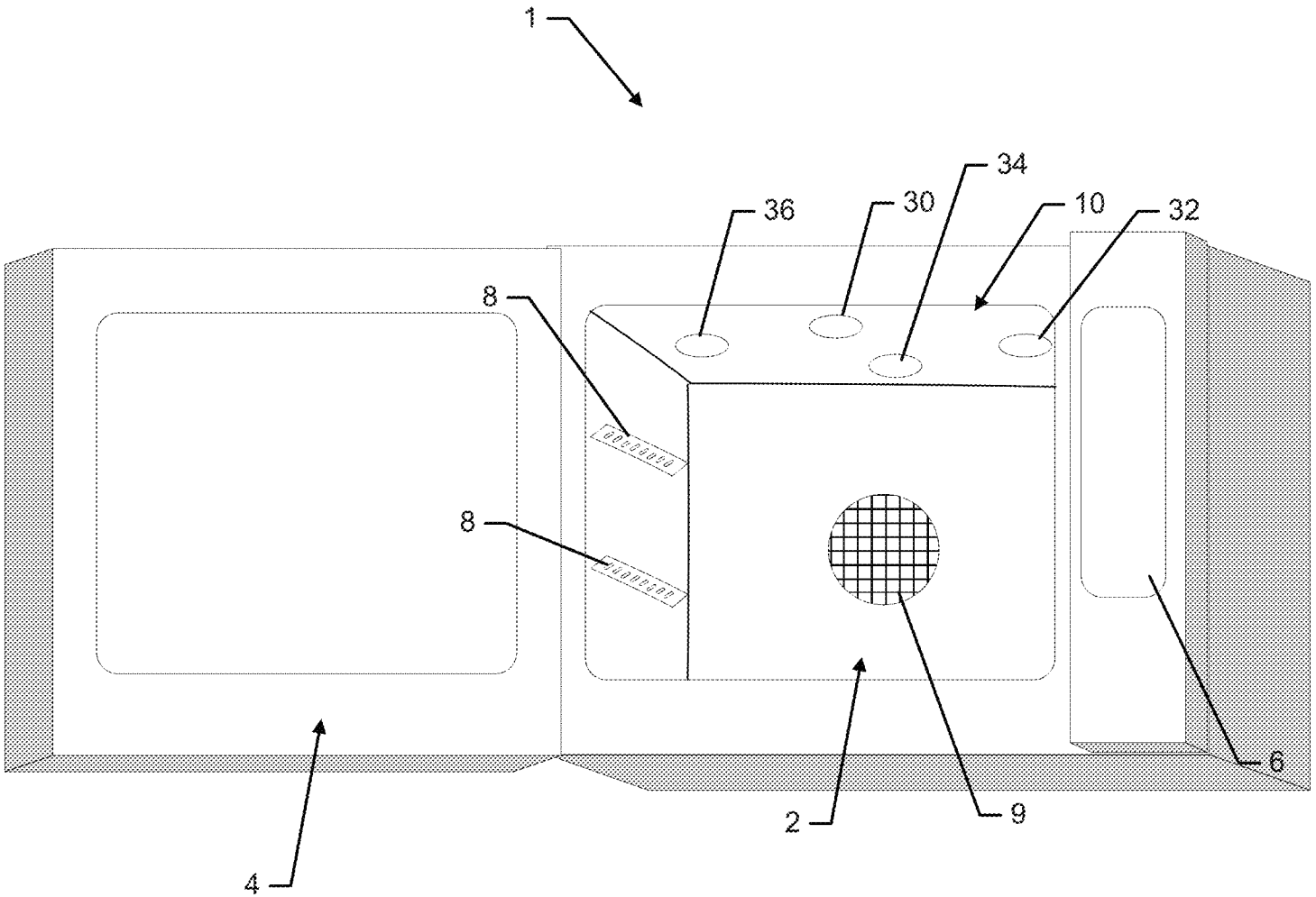
FIG. 1 illustrates a perspective view of an oven capable of employing an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other. Furthermore, as used herein the term "browning" should be understood to refer to the Maillard reaction or other desirable food coloration reactions whereby the food product is turned brown via enzymatic or non-enzymatic processes.

Some example embodiments may improve the cooking performance of an oven and/or may improve the operator experience of individuals employing an example embodiment. In this regard, some example embodiments may provide for the employment of solid state components to deliver energy into a cooking cavity. The solid state components may employ hybrid couplers and phase control via a cooking controller that interfaces with multiple antennas that provide the energy into the cooking cavity. In an example embodiment, the antennas may be provided in different areas of the ceiling of an oven to allow selective power distribution thereto. By selectively powering the antennas in sequences and/or combinations controlled by the cooking controller, a stirring effect can be achieved to alter the energy absorption characteristics of the oven and achieve a more even energy absorption into food placed in the oven cavity. Example embodiments may therefore assist with the provision of a well finished product using components that are longer lived, more efficient, and/or less costly.

FIG. 1 illustrates a perspective view of an oven 1 according to an example embodiment. As shown in FIG. 1, the oven 1 may include a cooking chamber 2 into which a food product may be placed for the application of heat by an energy application source that may be employed by the oven 1. The energy application source may be a radio frequency (RF) generator. As such, for example, the energy application source could be, a microwave frequency generator (e.g., in the range of 2.4 to 2.5 GHz) since the microwave frequency range is a subset of the RF frequency range.

The oven 1 may include a door 4 and an interface panel 6, which may sit proximate to the door 4 when the door 4 is closed. In an example embodiment, the interface panel 6 may include a touch screen display capable of providing visual indications to an operator and further capable of receiving touch inputs from the operator. However, other interface mechanisms are also possible. The interface panel 6 may be the mechanism by which instructions are provided by the operator, and the mechanism by which feedback is provided to the operator regarding cooking process status, options and/or the like.

In some embodiments, the oven 1 may include one or more rack (or pan) supports or guide slots in order to facilitate the insertion of one or more racks or pans holding food product that is to be cooked. Although no forced air is required in some embodiments, in others, one or more jet plates 8 may be positioned proximate to the rack supports (not shown) or corresponding racks to enable air to be forced over a surface of food product placed in a pan or rack associated with the corresponding rack supports via air delivery orifices disposed in the jet plates 8. If the jet plates 8 are employed, a chamber outlet port 9 may also be employed to extract air from the cooking chamber 2. After removal from the cooking chamber 2 via the chamber outlet port 9, air may be cleaned, heated, and pushed through the system by other components prior to return of the clean, hot and speed controlled air back into the cooking chamber 2. Of note, some embodiments may not employ forced air flow, and thus, the chamber outlet port 9 and the jet plates 8 may either be eliminated, or unused. They could also be arranged differently in some embodiments where they are used.

Food product placed on a rack or simply on a base of the cooking chamber 2 (e.g., in embodiments where racks are not employed) to be heated at least partially using RF or microwave energy. In an example embodiment, the RF or microwave energy may be provided into the cooking chamber 2, via an antenna assembly 10 that may be disposed in a ceiling portion (or top wall) of the cooking chamber 2. The antenna assembly 10 may include a plurality of antennas that may each include one or more antenna elements configured to generate frequency emissions when selectively operated as described herein.

In an example embodiment, the antenna assembly 10 may include a first antenna 30, a second antenna 32, a third antenna 34 and a fourth antenna 36. The first antenna 30 may be disposed at a front portion of the ceiling to generally cover, or generate RF or microwave frequencies to be absorbed at, a front portion of the cooking chamber 2. The second antenna 32 may be disposed at a right side portion of the ceiling (as viewed through the open door 4) to generally cover, or generate RF or microwave frequencies to be absorbed at, a right side portion of the cooking chamber 2. The third antenna 34 may be disposed at a rear portion of the ceiling to generally cover, or generate RF or microwave frequencies to be absorbed at, a rear portion of the cooking chamber 2. The fourth antenna 36 may be disposed at a left side portion of the ceiling (as viewed through the open door 4) to generally cover, or generate RF or microwave frequencies to be absorbed at, a left side portion of the cooking chamber 2.

In an example embodiment, each of the first, second, third and fourth antennas 30, 32, 34 and 36 may be disposed at the ceiling along a corresponding one of the longitudinal centerline or transverse centerline of the cooking chamber 2, proximate to the corresponding nearest one of the sidewalls, rear wall or the door. As such, the first antenna 30 and the third antenna 34 may mirror each other's positions at the front and rear portions, respectively, of the ceiling of the cooking chamber 2, and the second antenna 32 and the fourth antenna 36 may mirror each other's positions at the right and left portions, respectively, of the ceiling of the cooking chamber 2. However, it should be appreciated that the first, second, third and fourth antennas 30, 32, 34 and 36 could alternatively be provided in respective opposing corners of the ceiling of the cooking chamber 2 instead of being centrally located at front, rear, and side portions of the ceiling of the cooking chamber. Moreover, different numbers of antennas could also be employed in some cases. Thus, different numbers and positioning of the antennas could be employed in alternative embodiments. However, generally speaking, the use of four antennas at increments of ninety degrees apart from each other can be expected to provide relatively good performance and even distribution. In this regard, by employing phase control and selective power distribution to the antennas of the antenna assembly 10 displaced from each other at about ninety degree increments, a stirring effect can be obtained as described in greater detail below.

The antennas of the antenna assembly 10 may be provided in a space between the top wall (i.e., the ceiling) of the cooking chamber 2 and the outer housing of the oven 1, or the antenna assembly 10 may include antennas that extend into the cooking chamber 2 through the ceiling of the cooking chamber 2. If the antennas are physically located outside the cooking chamber 2, corresponding surfaces of the ceiling of the cooking chamber 2 may be substantially transparent to RF or microwave frequencies. Generally speaking, the antennas of the antenna assembly 10 may be disposed in a plane substantially parallel to a plane of the surface that supports the food product (or products) that are to be cooked in the cooking chamber 2. Accordingly, the antenna assembly 10 can more effectively provide full and relatively even coverage of the cooking chamber 2. Because the planar surface that supports the food product is typically the bottom surface of the oven 1, the ceiling is generally the optimal location for the antennas of the antenna assembly 10.

Figure 2:
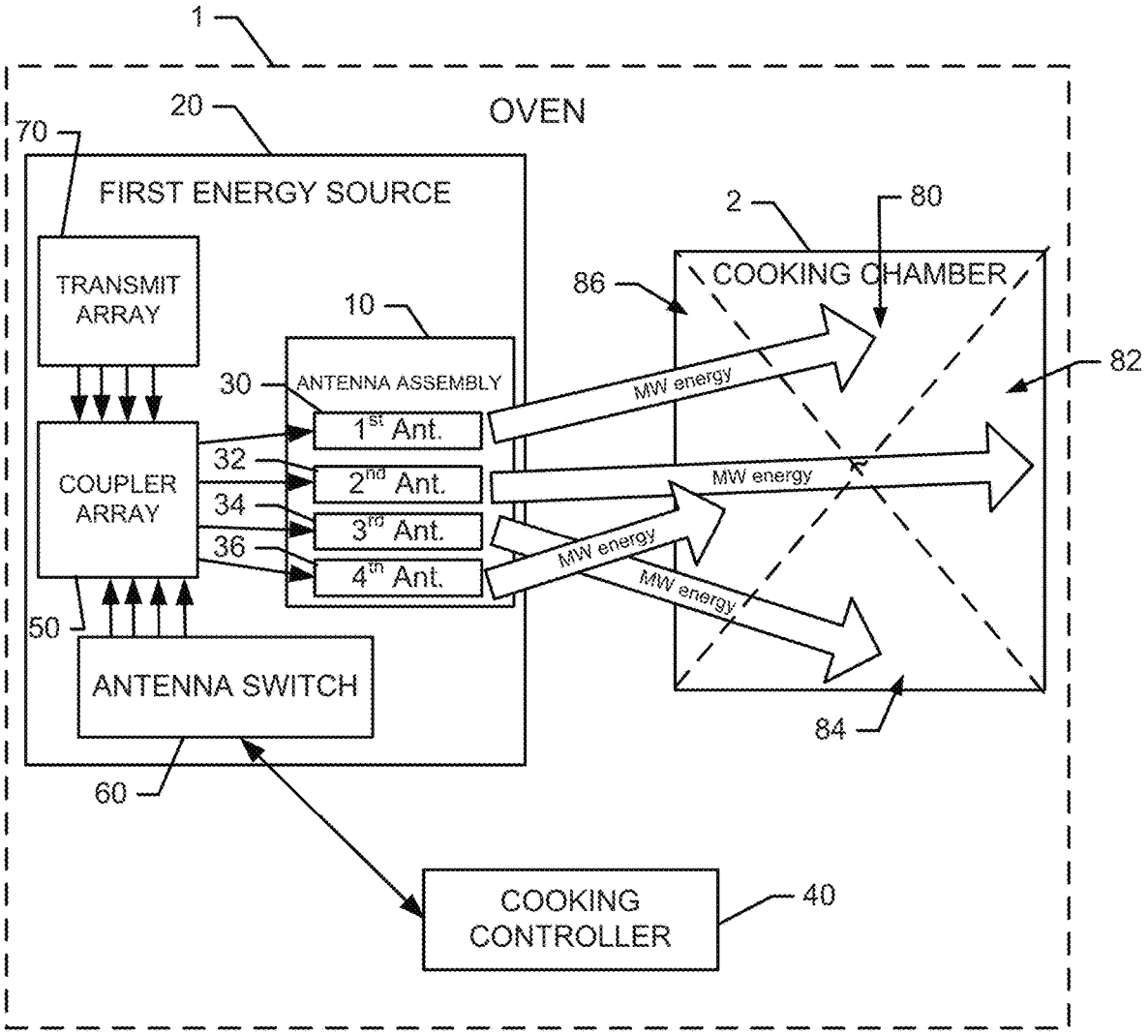
FIG. 2 illustrates a functional block diagram of the oven of FIG. 1 according to an example embodiment.

As indicated above, some example embodiments may employ a single type of energy (e.g., RF or microwave energy) for cooking food product in the cooking chamber 2. FIG. 2 illustrates a functional block diagram of the oven 1 according to an example embodiment. As shown in FIG. 2, the oven 1 may include at least a first energy source 20. Although not required (and absent from some embodiments), it is also possible that a second energy source could also be included. If employed, the second energy source may be, for example, a convective heating source. However, since the second energy source is not required, the example of FIG. 2 will be described in reference only to the first energy source 20.

In an example embodiment, the first energy source 20 may be an RF or microwave energy source (or heating source) configured to selectively generate RF energy or microwave energy based on phase controlled, selective coupling to evenly cook food product placed in the cooking chamber 2 of the oven 1. Thus, for example, the first energy source 20 may include the antenna assembly 10 and the corresponding antennas thereof. The antenna assembly 10 of one example embodiment may be configured to generate microwave energy at selected levels over a range of about 2.4 GHz to about 2.5 GHz. However, other RF energy bands may be employed in some cases. The antenna assembly 10 may be controlled by a cooking controller 40.

Each antenna of the antenna assembly 10 may be coupled to a corresponding output port of a coupler array 50. The coupler array 50 may include a number of output ports that is equal to the number of antennas in the antenna assembly 10. Each output port may be selectively activated based on the operation of an antenna switch 60 that is controlled by the cooking controller 40. The coupler array 50 may include a hybrid network array configured to couple a transmit array 70 to corresponding selected antennas of the antenna array 10 based on the inputs received from the antenna switch 50. In an example embodiment, the coupler array 50 may be configured to enable the selection of each of the antennas of the antenna assembly 10 individually, the selection of each opposite ended pair of antennas (e.g., the first antenna 30 with the third antenna 34 and the second antenna 32 with the fourth antenna 36), or the selection of all four antennas together. However, it should be appreciated that selections of adjacent antennas or groups of three antennas could also be accomplished in alternative embodiments.

Figure 3:
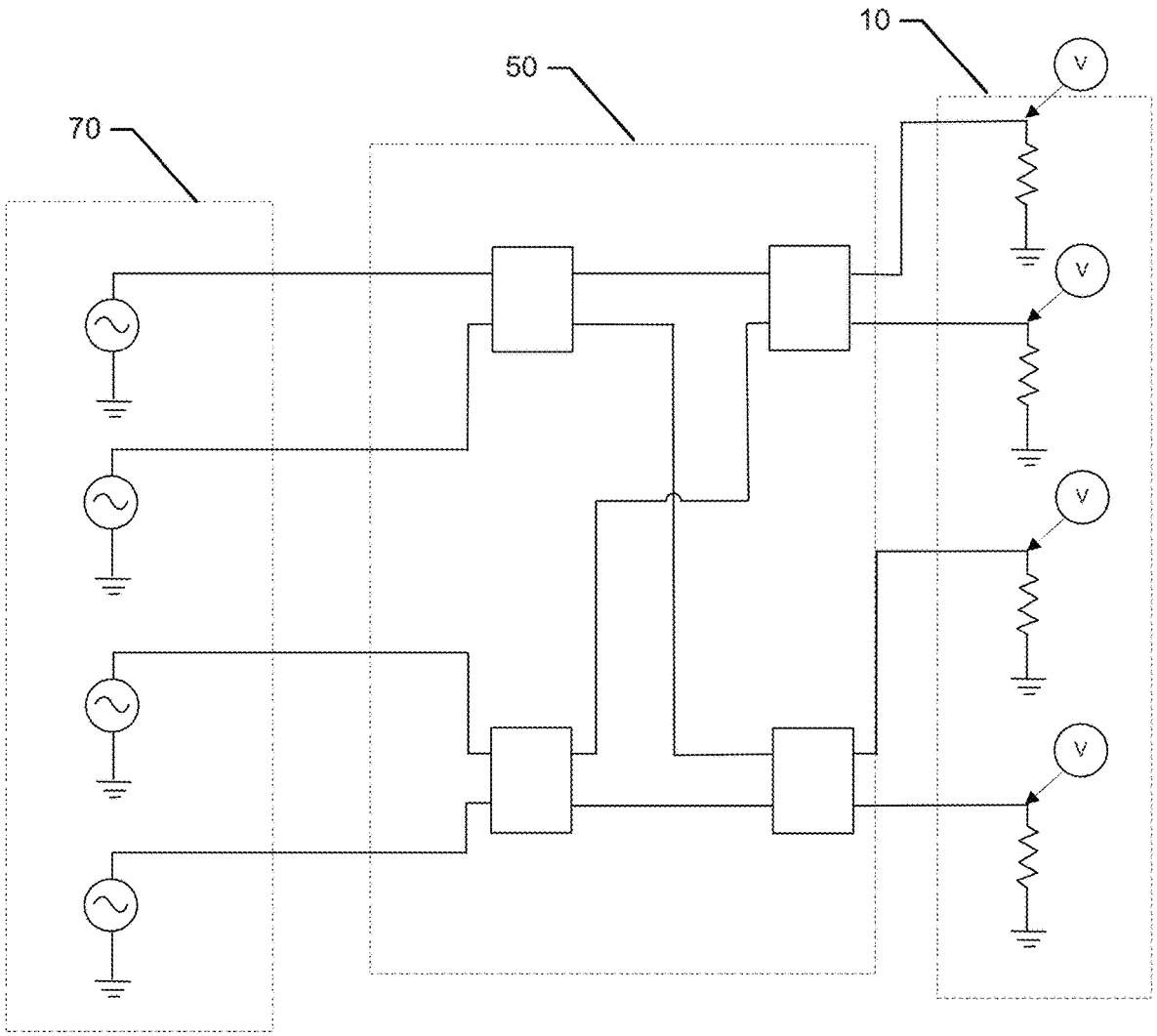
FIG. 3 illustrates a system diagram of some components of FIG. 2 according to an example embodiment.

FIG. 3 illustrates a block diagram of some portions of the example of FIG. 2 in accordance with an example embodiment. In this regard, the transmit array 70 is illustrated as a plurality of signal sources. Meanwhile, the coupler array 50 is illustrated as a plurality of hybrid couplers, branch lines, magic-tees, and/or the like that are configured to pass selected phases or phase combinations to the antenna array 10. In connection with the antenna array 10, the loads illustrated represent coupling to the cavity.

In an example embodiment, the transmit array 70 may include a number of transmitters that is equal to the number of antennas, and the transmitters may be powered, with their outputs selectively coupled to the antennas of the antenna assembly 10 by the internal circuitry of the coupler array 50 based on the inputs provided by the antenna switch 60. In an example embodiment, each transmitter of the transmit array 70 may be configured to enable a selected amount of energy to be directed to a corresponding antenna to achieve a total power value of the transmit array 70. However, corresponding portions of the antenna array 10 may only be powered for transmission when their respective outputs are enabled by being selected based on operation of the antenna switch 60. Thus, if the total power value is 1 KW, all four antennas may transmit at 250 KW to achieve the total power of 1 KW. However, if only a pair of antennas is transmitting (e.g., the first antenna 30 with the third antenna 34 or the second antenna 32 with the fourth antenna 36), the power of each may be 500 W to achieve the 1 KW total power value. Meanwhile, when only one antenna is transmitting, the power may be 1 KW. However, other total power settings and individual power settings may be employed in alternative embodiments.

In an example embodiment, each antenna may generally transmit in the same general direction as each other antenna (e.g., generally perpendicular to the plane in which the antennas are arrayed). Thus, each of the antennas may transmit in a direction substantially parallel to the direction that each other antenna transmits. Furthermore, each of the antennas may be configured to transmit into a corresponding separate zone or region of the cooking chamber 2. For example, the first antenna 30 may transmit into a first zone 80, the second antenna 32 may transmit into a second zone 82, the third antenna 34 may transmit into a third zone 84, and the fourth antenna 36 may transmit into a fourth zone 86, as shown in FIG. 2. The first, second, third and fourth zones 80, 82, 84 and 86 may each be provided at increments of ninety degrees to correlate to the respective antennas. It should be appreciated that there may be some amount of overlap between the zones.

The antenna assembly 10 may therefore be configured to transmit the microwave energy into the cooking chamber 2. In some cases, the antenna assembly 10 may further be configured to receive feedback to indicate absorption levels of respective different frequencies in the food product. The absorption levels may then be used to control the generation of microwave energy to provide balanced cooking of the food product. However, in some embodiments, the antenna assembly 10 may simply generate the microwave energy according to a program or algorithm that may be configured to enable the antenna assembly 10 to deliver relatively balanced and/or even energy distribution without any need for obtaining feedback. Thus, for example, four antennas may be provided and, in some cases, each antenna may be selectively controlled for directing microwave energy into the cooking chamber 2 under the control of the cooking controller 40.

In an example embodiment, the cooking controller 40 may be any means such as a device or circuitry embodied in either hardware, or a combination of hardware and software that is configured to execute (or provide instructions for execution of) a strategic control over power distribution to the antennas of the antenna array 10 to achieve balanced energy absorption in food products disposed in the cooking chamber 2. The balanced energy absorption may be facilitated by providing a stirring effect similar to that which occurs when a mechanical stirrer is used to stir magnetron emissions, or to an effect that is desired by employment of a turntable. However, the stirring effect that is achieved by example embodiments results from the alteration of power application to the antennas of the antenna assembly 10. Thus, for example, by altering the power distribution to the antennas of the antenna assembly 10, the avoidance of thermal hot spots.

Figure 4:
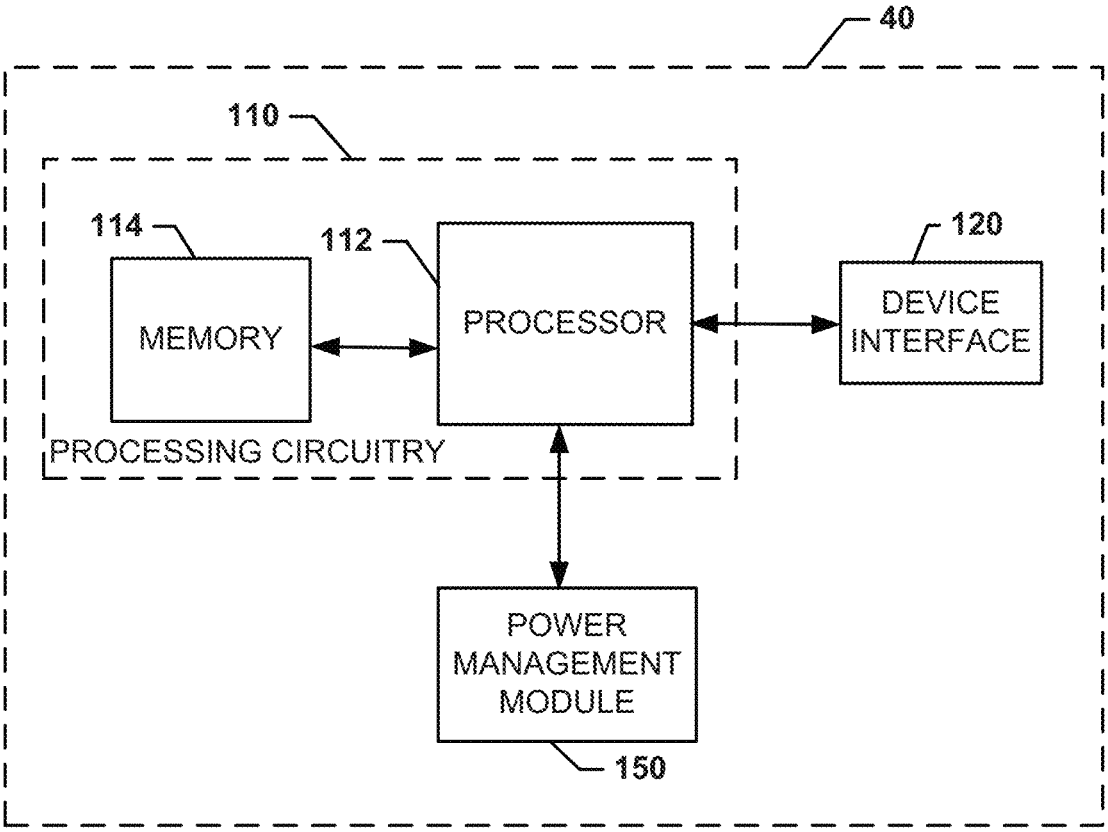
FIG. 4 illustrates a block diagram of a cooking controller according to an example embodiment.

FIG. 4 illustrates a block diagram of the cooking controller 40 in accordance with an example embodiment. In this regard, as shown in FIG. 4, the cooking controller 40 may include may include processing circuitry 110 that may be configured to interface with, control or otherwise coordinate the operations of various components or modules described herein in connection with controlling power distribution to the antenna assembly 10 as described herein. The cooking controller 40 may utilize the processing circuitry 110 to provide electronic control inputs to one or more functional units of the cooking controller 40 to receive, transmit and/or process data associated with the one or more functional units and perform communications necessary to enable the identification of a control algorithm that defines which patterns (e.g., predefined or random) of antenna power distribution are to be provided and then provides control of the antenna switch 60 to achieve such patterns as described herein.

In some embodiments, the processing circuitry 110 may be embodied as a chip or chip set. In other words, the processing circuitry 110 may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The processing circuitry 110 may therefore, in some cases, be configured to implement an embodiment of the present invention on a single chip or as a single "system on a chip." As such, in some cases, a chip or chipset may constitute means for performing one or more operations for providing the functionalities described herein.

In an example embodiment, the processing circuitry 110 may include one or more instances of a processor 112 and memory 114 that may be in communication with or otherwise control a device interface 120. As such, the processing circuitry 110 may be embodied as a circuit chip (e.g., an integrated circuit chip) configured (e.g., with hardware, software or a combination of hardware and software) to perform operations described herein.

The device interface 120 may include one or more interface mechanisms for enabling communication with other components or devices (e.g., the interface panel 6). In some cases, the device interface 120 may be any means such as a device or circuitry embodied in either hardware, or a combination of hardware and software that is configured to receive and/or transmit data from/to devices or components in communication with the processing circuitry 110 via internal and/or external communication mechanisms. Accordingly, for example, the device interface 120 may further include wired and/or wireless communication equipment for at least communicating with the antenna switch 60, and/or other components or modules described herein.

The processor 112 may be embodied in a number of different ways. For example, the processor 112 may be embodied as various processing means such as one or more of a microprocessor or other processing element, a coprocessor, a controller or various other computing or processing devices including integrated circuits such as, for example, an ASIC (application specific integrated circuit), an FPGA (field programmable gate array), or the like. In an example embodiment, the processor 112 may be configured to execute instructions stored in the memory 114 or otherwise accessible to the processor 112. As such, whether configured by hardware or by a combination of hardware and software, the processor 112 may represent an entity (e.g., physically embodied in circuitry—in the form of processing circuitry 110) capable of performing operations according to embodiments of the present invention while configured accordingly. Thus, for example, when the processor 112 is embodied as an ASIC, FPGA or the like, the processor 112 may be specifically configured hardware for conducting the operations described herein. Alternatively, as another example, when the processor 112 is embodied as an executor of software instructions, the instructions may specifically configure the processor 112 to perform the operations described herein in reference to execution of an example embodiment.

In an exemplary embodiment, the memory 114 may include one or more non-transitory memory devices such as, for example, volatile and/or non-volatile memory that may be either fixed or removable. The memory 114 may be configured to store information, data, applications, instructions or the like for enabling the processing circuitry 110 to carry out various functions in accordance with exemplary embodiments of the present invention. For example, the memory 114 may be configured to buffer input data for processing by the processor 112. Additionally or alternatively, the memory 114 may be configured to store instructions for execution by the processor 112. As yet another alternative or additional capability, the memory 114 may include one or more databases that may store a variety of data sets or tables useful for operation of the modules described below and/or the processing circuitry 110. Among the contents of the memory 114, applications or instruction sets may be stored for execution by the processor 112 in order to carry out the functionality associated with each respective application or instruction set. In some cases, the applications/instruction sets may include instructions for carrying out some or all of the operations described in reference to algorithms or flow charts for directing control over power distribution as described herein. In particular, the memory 114 may store executable instructions that enable the computational power of the processing circuitry 110 to be employed to improve the functioning of the cooking controller 40 relative to the control over antenna power distribution as described herein. As such, the improved operation of the computational components of the cooking controller 40 transforms the cooking controller 40 into a more capable power distribution control device relative to the antenna assembly 10 and/or oven 1 associated with executing example embodiments.

As shown in FIG. 4, the cooking controller 40 may further include (or otherwise be operably coupled to) a power management module 150. In some examples, the processor 112 (or the processing circuitry 110) may be embodied as, include or otherwise control various modules (e.g., the power management module 150) that are configured to perform respective different tasks associated with the cooking controller 40. As such, in some embodiments, the processor 112 (or the processing circuitry 110) may be said to cause each of the operations described in connection with the power management module 150 as described herein.

The power management module 150 may be any means such as a device or circuitry embodied in either hardware, or a combination of hardware and software that is configured to execute control over the distribution of power to the antenna assembly 10. In this regard, the power management module 150 may be configured to receive cooking information (e.g., from a user via that interface panel 6) regarding the food product or a cooking mode or program to be executed. Based on the cooking information provided, the power management module 150 may select a power distribution algorithm from among a plurality of stored power distribution algorithms. The selected power distribution algorithm may then be executed to control the antenna switch 60 to provide power to the antennas of the antenna assembly 10 in the desired pattern (e.g., predetermined or random).

In an example embodiment, the power management module 150 may include a plurality of stored algorithms, each of which defines a corresponding pattern (e.g., predetermined or random) for power distribution to the antennas of the antenna assembly 10 (e.g., via control of the antenna switch 60). In some cases, the stored algorithms may be associated with corresponding different cooking programs, cooking modes, or such algorithms may be named and selectable by the user from a menu. Regardless of how selected, once the power management module 150 selects an algorithm, the selected power distribution algorithm may be executed by the processing circuitry 110, which ultimately provides for control inputs to be provided to the antenna switch 60 to ensure that the desired pattern of energizing the antennas of the antenna assembly 10 is executed.

In some embodiments, the cooking controller 40 (and/or the power management module 150) may be configured to receive static and/or dynamic inputs regarding the food product and/or cooking conditions. Dynamic inputs may include feedback data regarding absorption of RF spectrum, as described above. In some cases, dynamic inputs may include adjustments made by the operator during the cooking process. The static inputs may include parameters that are input by the operator as initial conditions. For example, the static inputs may include a description of the food type, initial state or temperature, final desired state or temperature, a number and/or size of portions to be cooked, a location of the item to be cooked (e.g., when multiple trays or levels are employed), and/or the like.

In some examples, each antenna is excited through a combination of hybrid RF couplers by a high power source that is capable of multiple phase and frequency combinations. The high power source may be a cascade of a phase variable synthesizer, a variable gain amplifier chain, and a high power output amplifier. By utilizing 90 degree increments in phase, the power can be directed to various different combinations of antennas. FIG. 5 illustrates a table 200 showing phase combinations to excite the antenna combinations desired according to various examples. In the example of FIG. 5, the various sources are normalized to 1V. The table shows probe measurements to illustrate the effect of phase combinations on antenna selection.

As mentioned above, different zones can be defined based on their proximity or location relative to the antennas of the antenna assembly. FIG. 6, which includes FIGS. 6A, 6B, 6C, 6D, 6E, 6F and 6G, illustrates field patterns achievable based on various selection patterns in accordance with an example embodiment. In FIG. 6, highlighted or brighter regions represent regions in which power is being absorbed in a sample load. The sample load, for simulation purposes, is a series of distributed ¼ wave cubes that are provided in the cooking chamber 2.

Figure 6A:
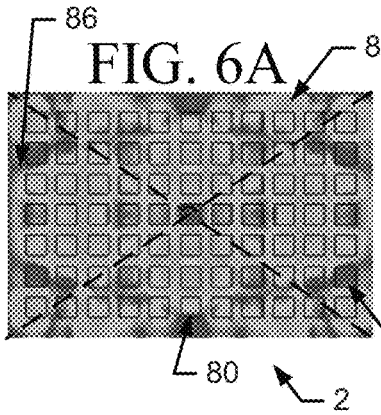
FIGS. 6A, 6B, 6C, 6D, 6E, 6F and 6G, illustrates field patterns achievable based on various selection patterns in accordance with an example embodiment.
Figure 6B:
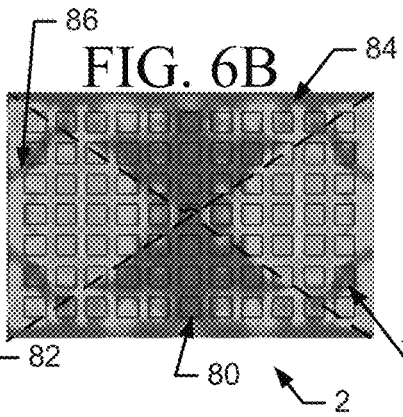
Figure 6C:
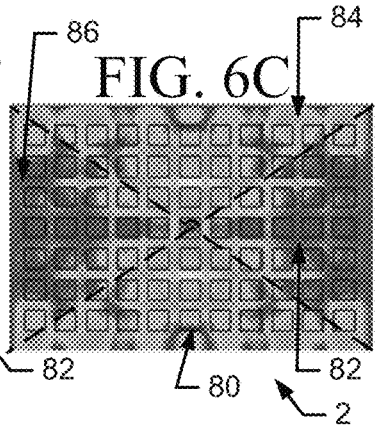

The example of FIG. 6A shows all four antennas radiating. Thus, absorption is relatively evenly distributed throughout the cooking chamber 2. However, it can be seen that some spots have less absorption than others. Meanwhile, FIG. 6B shows right and left side antennas (e.g., the second antenna 32 and the fourth antenna 36 radiating). Regions near the front and back of the cooking chamber 2 remain dark to show that absorption in those regions (i.e., the first region 80 and the third region 84) is relatively low. FIG. 6C shows front and back antennas (e.g., the first antenna 30 and the third antenna 34 radiating). Regions near the front and back of the cooking chamber 2 are bright showing high absorption in the first region 80 and the third region 84. Meanwhile, regions near the opposing sides are dark to show that absorption in those regions (i.e., the second region 82 and the fourth region 86) is relatively low.

Figure 6D:
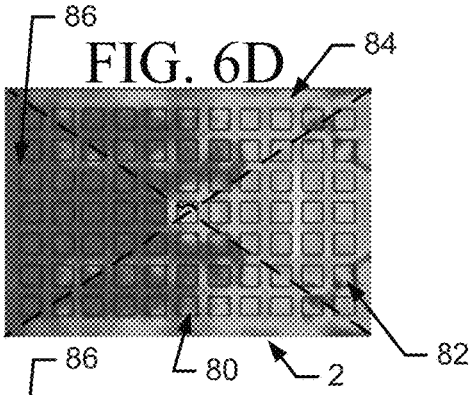
Figure 6E:
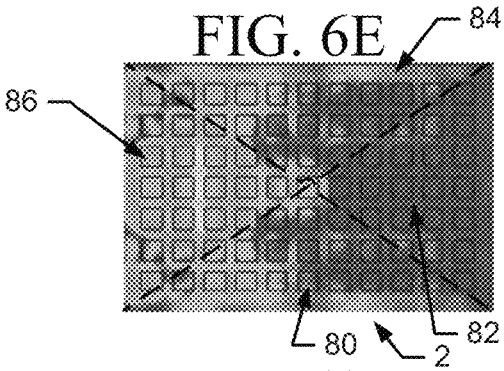
Figure 6F:
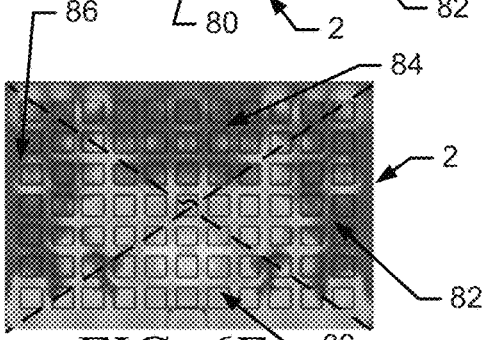
Figure 6G:
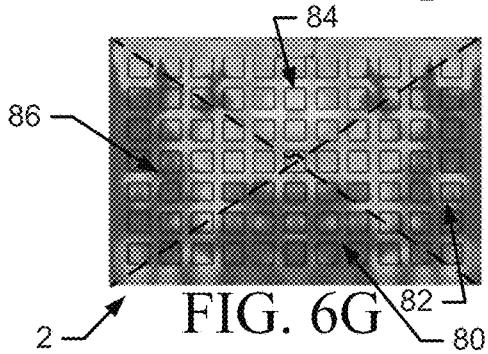

FIG. 6D illustrates only the right side antenna (e.g., the second antenna 32) radiating so that absorption is high only in the second region 82. FIG. 6E illustrates only the left side antenna (e.g., the fourth antenna 36) radiating so that absorption is high only in the fourth region 86. FIG. 6F illustrates only the front antenna (e.g., the first antenna 30) radiating so that absorption is high only in the first region 80. FIG. 6G illustrates only the rear antenna (e.g., the third antenna 34) radiating so that absorption is high only in the third region 84.

As can be appreciated from FIG. 6, various combinations or sequences alternating between the individual states shown in FIGS. 6A to 6G can be used to define patterns for emission of RF energy into the cooking chamber 2 into the respective zones. Moreover, these patterns may be pseudo-random or may be predefined patterns involving the combinations shown in FIG. 6 (or perhaps also other combinations). The cooking controller 40 may be configured to control this pattern selection via the antenna switch 60 as described above to control the coupler array 50. The control of pattern selection, or the pattern itself, may be embodied via a selected power distribution algorithm that defines the states and/or sequences of states that are to be initiated.

An oven of an example embodiment may therefore employ cooking controller to provide for selective power distribution described herein. In particular, for example, an oven may include a cooking chamber configured to receive a food product, an antenna assembly and a cooking controller. The antenna assembly may include a plurality of antennas provided in increments corresponding to respective zones of the cooking chamber. The cooking controller may be operably coupled to the antenna assembly to selectively distribute power to respective ones of the antennas of the antenna assembly to provide radio frequency energy into the respective zones in a selected pattern.

In some cases, the oven may include various modifications, additions or augmentations that may optionally be applied. Thus, for example, in some cases, the antenna assembly may include a first antenna disposed to provide RF energy into a first zone of the cooking chamber, a second antenna disposed to provide RF energy into a second zone of the cooking chamber, a third antenna disposed to provide RF energy into a third zone of the cooking chamber, and a fourth antenna disposed to provide RF energy into a fourth zone of the cooking chamber. In an example embodiment, the selected pattern may include alternating power distribution to a combination of the first, second, third and fourth antennas, to a combination of the first and third antennas, to a combination of the second and fourth antennas, or to any single one of the first, second, third and fourth antennas. In some cases, the selected pattern is a predetermined pattern or a pseudo-random pattern. In some examples, the oven may further include a coupler array operably coupling a transmit array to the antenna assembly, and an antenna switch operably coupled to the coupler array to control antenna selection based on input from the cooking controller. In an example embodiment, power amplifiers of the transmit array may each be configured to generate between about 250 W to 1 KW of energy and, responsive to control by the cooking controller, power levels may vary between 1 KW for selection of one of the first, second, third or fourth antenna to achieve 1 KW total power to 250 W for selection of all of the first, second, third and fourth antennas to achieve 1 KW total power. In some cases, the cooking controller may be configured to store a power distribution algorithm that, when executed, controls the antenna switch to provide the RF energy to the respective zones in the selected pattern. In some embodiments, each of the first, second, third and fourth antennas may be provided at 90 degree increments. In an example embodiment, the RF energy comprises microwave energy between about 2.4 GHz and about 2.5 GHz.

Example embodiments define zones based on the antennas aligned therewith. The duty cycle of each antenna may be controlled to provide various different sequences and/or patterns of simultaneously operating antennas to change the radiation patterns for RF energy in the cooking chamber.

Thus, a stirring effect may be achieved with solid state components instead of requiring a turntable or mechanical stirrer for use with a conventional magnetron. As a result, a highly versatile and customizable cooking arrangement may be provided.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An oven comprising:

a cooking chamber configured to receive a food product;

an antenna assembly comprising a plurality of antennas provided in increments corresponding to respective zones of the cooking chamber; and a cooking controller operably coupled to the antenna assembly to selectively distribute power to respective ones of the antennas of the antenna assembly to provide radio frequency (RF) energy into the respective zones in a selected pattern while maintaining a constant total power, wherein the cooking controller is configured to selectively distribute the power by changing, according to the selected pattern, power applied to each of the respective ones of the antennas to be a selected one of no power, the total power, and a multiple of the total power divided by a number of the antennas to stir the RF energy applied to the food product within the cooking chamber without rotation of the food product.

2. The oven of claim 1, wherein the antenna assembly comprises:

a first antenna disposed to provide RF energy into a first zone of the cooking chamber;

a second antenna disposed to provide RF energy into a second zone of the cooking chamber;

a third antenna disposed to provide RF energy into a third zone of the cooking chamber; and a fourth antenna disposed to provide RF energy into a fourth zone of the cooking chamber.

3. The oven of claim 1, wherein the RF energy comprises microwave energy between about 2.4 GHz and about 2.5 GHz.

4. The oven of claim 2, wherein the selected pattern comprises alternating power distribution to:

a combination of the first, second, third and fourth antennas;

a combination of the first and third antennas;

a combination of the second and fourth antennas; and any single one of the first, second, third and fourth antennas.

5. The oven of claim 2, further comprising a coupler array operably coupling a transmit array to the antenna assembly, and an antenna switch operably coupled to the coupler array to control antenna selection based on input from the cooking controller.

6. The oven of claim 2, wherein each of the first, second, third and fourth antennas are provided at 90 degree increments.

7. The oven of claim 4, wherein the selected pattern is a predetermined pattern.

8. The oven of claim 4, wherein the selected pattern is a pseudo-random pattern.

9. The oven of claim 5, wherein power amplifiers of the transmit array are each configured to generate between about 250 W and 1 KW of energy, and wherein, responsive to control by the cooking controller, power levels vary between 1 KW for selection of one of the first, second, third or fourth antenna to achieve 1 KW total power to 250 W for selection of all of the first, second, third and fourth antennas to achieve 1 KW total power.

10. The oven of claim 5, wherein the cooking controller is configured to store a power distribution algorithm that, when executed, controls the antenna switch to provide the RF energy to the respective zones in the selected pattern.

11. A power distribution system for an oven, the power distribution system comprising:

an antenna assembly comprising a plurality of antennas provided in increments corresponding to respective zones of a cooking chamber of the oven; and a cooking controller operably coupled to the antenna assembly to selectively distribute power to respective ones of the antennas of the antenna assembly to provide radio frequency (RF) energy into the respective zones in a selected pattern while maintaining a constant total power, wherein the cooking controller is configured to selectively distribute the power by changing, according to the selected pattern, power applied to each of the respective ones of the antennas to be a selected one of no power, the total power, and a multiple of the total power divided by a number of the antennas to stir the RF energy applied to a food product within the cooking chamber without rotation of the food product.

12. The power distribution system of claim 11, wherein the antenna assembly comprises:

a first antenna disposed to provide RF energy into a first zone of the cooking chamber;

a second antenna disposed to provide RF energy into a second zone of the cooking chamber;

a third antenna disposed to provide RF energy into a third zone of the cooking chamber; and a fourth antenna disposed to provide RF energy into a fourth zone of the cooking chamber.

13. The power distribution system of claim 11, wherein the RF energy comprises microwave energy between about 2.4 GHz and about 2.5 GHz.

14. The power distribution system of claim 12, wherein the selected pattern comprises alternating power distribution to:

a combination of the first, second, third and fourth antennas;

a combination of the first and third antennas;

a combination of the second and fourth antennas; and any single one of the first, second, third and fourth antennas.

15. The power distribution system of claim 12, further comprising a coupler array operably coupling a transmit array to the antenna assembly, and an antenna switch operably coupled to the coupler array to control antenna selection based on input from the cooking controller.

16. The power distribution system of claim 12, wherein each of the first, second, third and fourth antennas are provided at 90 degree increments.

17. The power distribution system of claim 14, wherein the selected pattern is a predetermined pattern.

18. The power distribution system of claim 14, wherein the selected pattern is a pseudo-random pattern.

19. The power distribution system of claim 15, wherein power amplifiers of the transmit array are each configured to generate between about 250 W and 1 KW of energy, and wherein, responsive to control by the cooking controller, power levels vary between 1 KW for selection of one of the first, second, third or fourth antenna to achieve 1 KW total power to 250 W for selection of all of the first, second, third and fourth antennas to achieve 1 KW total power.

20. The power distribution system of claim 15, wherein the cooking controller is configured to store a power distribution algorithm that, when executed, controls the antenna switch to provide the RF energy to the respective zones in the selected pattern.

* * * * *